US010604932B2

(12) United States Patent
Von Allmen

(10) Patent No.: US 10,604,932 B2
(45) Date of Patent: Mar. 31, 2020

(54) LATTICE STRUCTURE AND A DEVICE AND METHOD FOR PRODUCING SAME

(71) Applicant: Geobrugg AG, Romanshorn (CH)

(72) Inventor: Hans-Peter Von Allmen, Tafers (CH)

(73) Assignee: Geobrugg AG, Romanshorn (DE)

( * ) Notice: Subject to any disclaimer, the term of this patent is extended or adjusted under 35 U.S.C. 154(b) by 0 days.

(21) Appl. No.: 15/737,462

(22) PCT Filed: May 25, 2016

(86) PCT No.: PCT/EP2016/061826

§ 371 (c)(1),
(2) Date: Dec. 18, 2017

(87) PCT Pub. No.: WO2016/202545

PCT Pub. Date: Dec. 22, 2016

(65) Prior Publication Data

US 2018/0195284 A1 Jul. 12, 2018

(30) Foreign Application Priority Data

Jun. 19, 2015 (CH) ..... 0920/15

(51) Int. Cl.

| | |
|---|---|
| ***E04C 5/06*** | (2006.01) |
| ***B21F 27/02*** | (2006.01) |
| ***E04C 5/04*** | (2006.01) |
| ***B21F 27/00*** | (2006.01) |

(52) U.S. Cl.

CPC ..... *E04C 5/06* (2013.01); *B21F 27/005* (2013.01); *B21F 27/02* (2013.01); *E04C 5/04* (2013.01)

(58) Field of Classification Search

CPC ..... E04C 5/06; B21F 27/02; B21F 27/005

See application file for complete search history.

(56) References Cited

U.S. PATENT DOCUMENTS

| | | | | |
|---|---|---|---|---|
| 483,186 A | | 9/1892 | Trick | |
| 1,259,869 A | * | 3/1918 | Jackson | B21F 33/04 140/101 |

(Continued)

FOREIGN PATENT DOCUMENTS

| | | | | |
|---|---|---|---|---|
| DE | 636980 C | | 10/1936 | |
| DE | 2613222 A1 | * | 11/1977 | B21F 27/02 |

(Continued)

OTHER PUBLICATIONS

International Search Report of the International Searching Authority dated Aug. 4, 2016 for the corresponding International application No. PCT/EP2016/061826.

(Continued)

*Primary Examiner* — Adriana Figueroa

(74) *Attorney, Agent, or Firm* — Posz Law Group, PLC

(57) ABSTRACT

A lattice structure is composed of intersecting longitudinal elements and transverse elements, e.g. wires, strands, ropes, rods and/or profiles, with intersection points allocated to the longitudinal elements and transverse elements.

Figure 4:
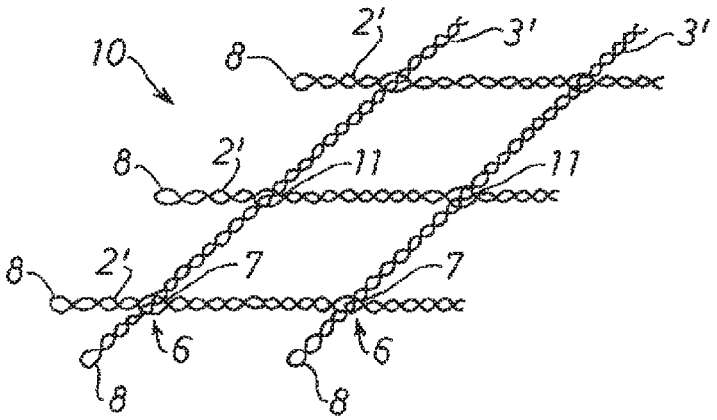

The longitudinal elements and transverse elements, extending in unifold and/or multifold fashion, are connected to one another at least in the intersection points, in particular via twisting, passing into one another and/or knotting with one another.

1 Claim, 4 Drawing Sheets

(56) References Cited

U.S. PATENT DOCUMENTS

| | | | | | |
|---|---|---|---|---|---|
| 1,907,056 | A * | 5/1933 | Galloway | B21F 27/005 | 139/425 R |
| 2,162,115 | A * | 6/1939 | Pauls | D04G 1/00 | 43/9.95 |
| 2,708,454 | A * | 5/1955 | Crouch | B21F 27/02 | 139/28 |
| 2,888,854 | A * | 6/1959 | Johnson | D04G 1/00 | 289/1.2 |
| 2,954,964 | A * | 10/1960 | O'Haffey | B21F 27/005 | 256/12.5 |
| 3,087,699 | A * | 4/1963 | Foster | B21F 27/005 | 139/425 R |
| 3,899,227 | A * | 8/1975 | Hang | B21F 27/005 | 29/898.059 |
| 4,008,912 | A | 2/1977 | Kotov | | |
| 4,081,148 | A * | 3/1978 | Murphy | A01G 9/12 | 245/5 |
| 4,245,926 | A * | 1/1981 | Asszonyi | B21F 27/20 | 405/150.1 |
| 4,487,000 | A * | 12/1984 | Ball | E04C 5/04 | 52/660 |
| 5,788,223 | A * | 8/1998 | Stockton | B21F 27/02 | 256/2 |
| 6,279,858 | B1 * | 8/2001 | Eicher | B21D 11/07 | 245/8 |
| 6,738,265 | B1 * | 5/2004 | Svarfvar | D04C 1/06 | 174/358 |
| 8,079,197 | B2 * | 12/2011 | Suarez, Sr. | E04C 5/06 | 52/414 |
| 9,185,887 | B2 * | 11/2015 | Suazo Luengo | B21F 27/02 | |
| 9,863,099 | B2 * | 1/2018 | Cornelus | E02D 29/0225 | |
| 2004/0251688 | A1 | 12/2004 | Safwat et al. | | |
| 2007/0210214 | A1 * | 9/2007 | Wartmann | B21F 27/02 | 245/5 |
| 2008/0276564 | A1 * | 11/2008 | Offersen | B21F 27/02 | 52/676 |
| 2016/0145816 | A1 * | 5/2016 | Fulde | E02D 17/202 | 405/302.7 |

FOREIGN PATENT DOCUMENTS

| | | | | | |
|---|---|---|---|---|---|
| DE | 3916293 | A1 * | 11/1990 | E04C 2/425 | |
| EP | 1 726 742 | A2 | 11/2006 | | |
| EP | 1795279 | A1 * | 6/2007 | B21F 27/02 | |
| FR | 413962 | A | 8/1910 | | |
| GB | 172476 | | 12/1921 | | |
| GB | 178987 | A * | 5/1922 | E04C 5/04 | |
| GB | 243836 | A * | 12/1925 | E04C 5/04 | |
| JP | S56-023245 | A | 7/1979 | | |
| JP | 63-018506 | A | 1/1988 | | |
| JP | H08-144432 | A | 6/1996 | | |
| JP | 2008-501878 | A | 1/2008 | | |
| JP | 2009-039751 | A | 2/2009 | | |
| JP | 2013-057236 | A | 3/2013 | | |
| RU | 2001126489 | A | 3/2004 | | |
| SU | 602277 | A1 | 4/1978 | | |
| SU | 919794 | A1 | 4/1982 | | |
| WO | WO-2015114177 | A1 * | 8/2015 | B21F 27/14 | |

OTHER PUBLICATIONS

International Preliminary Report on Patentability of the International Searching Authority dated Dec. 19, 2017 for the corresponding international application No. PCT/EP2016/061826.

Office Action of Dec. 5, 2018 issued in corresponding CO patent application No. NC2017/0013071 (and English summary).

Office Action of Dec. 24, 2018 issued in corresponding RU patent application No. 2018 101 983 (and English translation).

Office action dated Dec. 21, 2018 issued in corresponding CA patent application No. 2,989,915.

Office action dated Feb. 19, 2019 issued in corresponding JP patent application No. 2017-565746 (and English translation thereof).

Office action dated Jan. 15, 2019 issued in corresponding NZ patent application No. 738590.

Office action dated May 5, 2019 issued in corresponding CN patent application No. 201680045673.6 (and English translation thereof).

Office action dated Apr. 19, 2019 issued in corresponding KR patent application No. 10-2018-7001395 (and English translation thereof).

Office Action dated Feb. 8, 2019 issued in corresponding CL patent application No. Cl 3272-2017 (English translation only).

Office Action dated Jun. 11, 2018 issued in con-esponding NZ patent application No. NZ 738590.

Office Action dated Jul. 19, 2019 issued in corresponding CL patent application No. 3272-2017 (and English summary).

Office Action dated Oct. 1, 2019 issued in corresponding in patent application No. 201827000171.

Office action dated Jun. 7, 2019 issued in corresponding Colombian patent application No. NC2017/0013071 (and English translation thereof).

Office action dated Jul. 4, 2019 issued in corresponding EP patent application No. 16 728 858.8 (and English translation thereof).

Office Action dated Oct. 11, 2019 issued in corresponding KR patent application No. 10-2018-7001395 (and English translation).

* cited by examiner

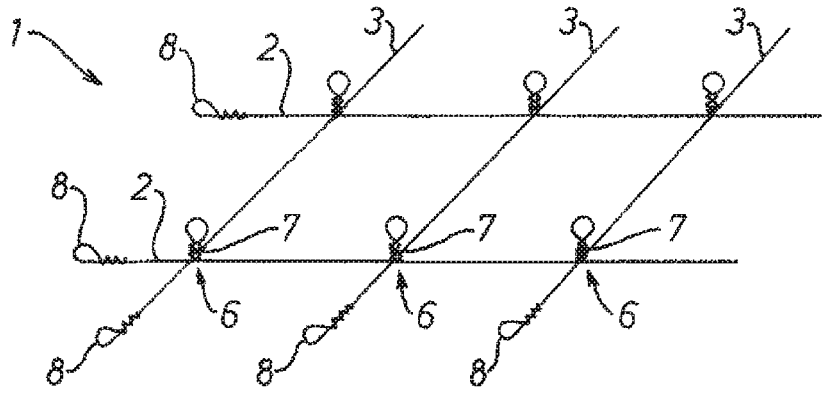
Fig. 1
Fig. 2
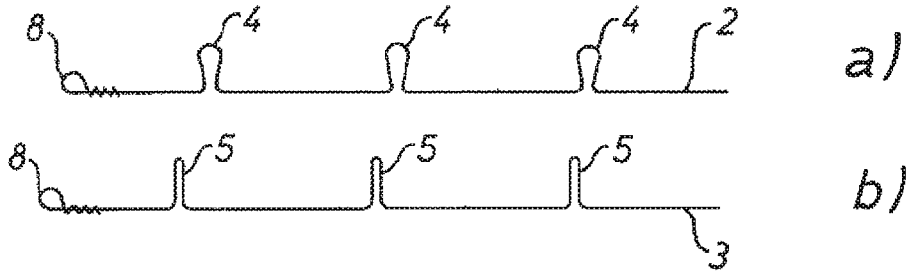
a) b) Fig. 3
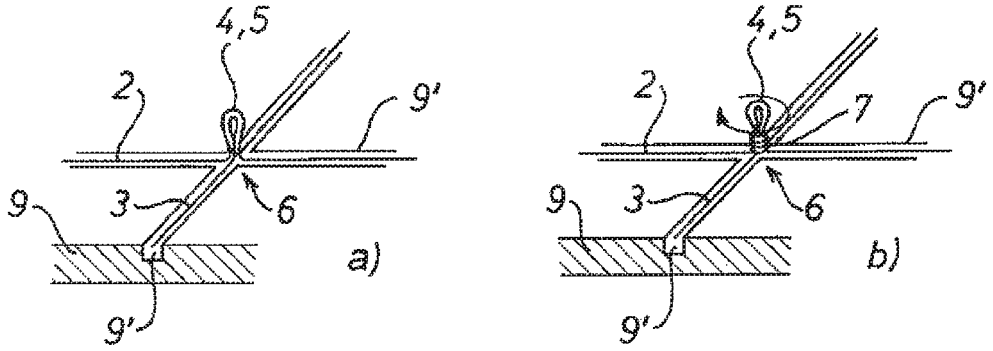

LATTICE STRUCTURE AND A DEVICE AND METHOD FOR PRODUCING SAME

CROSS REFERENCE TO RELATED APPLICATIONS

This application is a U.S. national stage application of PCT/EP2016/061826 filed on May 25, 2016, which is based on Swiss Patent Application No. 00920/15 filed on Jun. 19, 2015, the contents of which are incorporated herein by reference.

The invention concerns a lattice structure according to the preamble of claim 1.

Lattice structures of this kind are used as structural elements implemented as flat or undulated support grids or protective gratings, wherein the thrust-resistance of the knot points ensures that the lattice is only slightly deformed even in case of huge loads. For the purpose of connecting the wires in the knot points, welding connections, clamps or additional wire material have been used until now.

A lattice structure of this type is disclosed in AT 409 506 B. It is composed of rod-shaped upper belts and lower belts, between which connecting rods have been welded in. These welding points implementing the knot points cause, on the one hand, structural changes and, on the other hand, involve a huge manufacturing effort when the belt rods are welded together. The latter also applies when using mechanically machined connecting elements, which also come with a high input regarding workforce and cost.

In view of the above, the objective of the invention is to avoid these shortcomings and to create a lattice structure of the type previously mentioned, the knot points of which comprise neither welding points nor additional materials, and which is producible in an efficient and economically expedient fashion. Furthermore a durable corrosion protection of the lattice structure is also to be ensured.

In this way a non-displaceable connection is achieved between longitudinal elements and transverse elements, which may be implemented without external connecting elements, involving comparably low input. In addition, an increased lifespan of the lattice structure results as there are no weakening welding points or the like in the knot points.

The lattice according to the invention may be implemented in a variety of embodiments. In a first exemplary embodiment the invention teaches that the longitudinal elements and transverse elements of the lattice are furnished with non-twisted or partly pre-twisted loops along the elements, preferably perpendicularly to the lattice plane, which are open or closed and are twisted with one another in the intersection points of the elements, thus implementing knot points. To facilitate said connecting, the loops of the longitudinal wires are arranged in a longitudinal direction of the wires while the loops of the transverse elements are oriented transversely to the longitudinal direction of the wires. It is however also easily possible to provide, vice-versa, the longitudinal wires with loops which are arranged transversely to the longitudinal direction of the wires while the transverse elements are furnished with loops arranged in the longitudinal direction of the wires.

In a second embodiment the invention teaches that the lattice is composed of longitudinal elements and transverse elements, which extend at least in two-fold and are twisted in themselves and are passed into and through one another in the intersection points of the wires.

It is herein expedient to preferably furnish the longitudinal wires, strands, ropes, rods or profiles with pass-through regions for receiving the transverse elements passing through them or past them. Vice versa, it is however also possible to implement the pass-through regions in the transverse elements, guiding the longitudinal wires through the transverse elements.

An additional advantage is achieved in a version of this embodiment wherein the longitudinal elements and transverse elements extending in two-fold fashion are implemented to be twisted only in a region of the intersection points.

Regarding a stability of the lattice in a load state, it is advantageous if the longitudinal elements and transverse elements are oriented lying in a plane at right angles with respect to one another. However, the implementation of the knot points according to the invention is easily applicable in lattices with other intersection angles as well.

In terms of manufacturing technique, it is advantageous if the distances between the knot points of the lattice are regular in a longitudinal, and/or transverse direction.

Advantageously the longitudinal elements and/or transverse elements are made at least partly of high-tensile steel, preferably with a strength of 700 N $mm^{-2}$ to 2800 N $mm^{-2}$.

Figure 5:
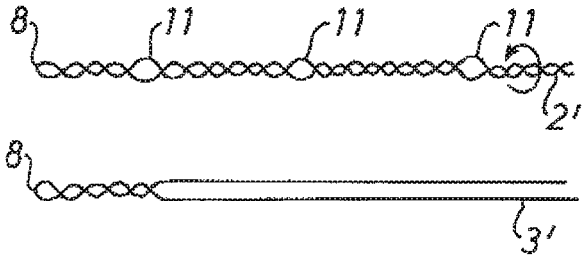
Figure 6:
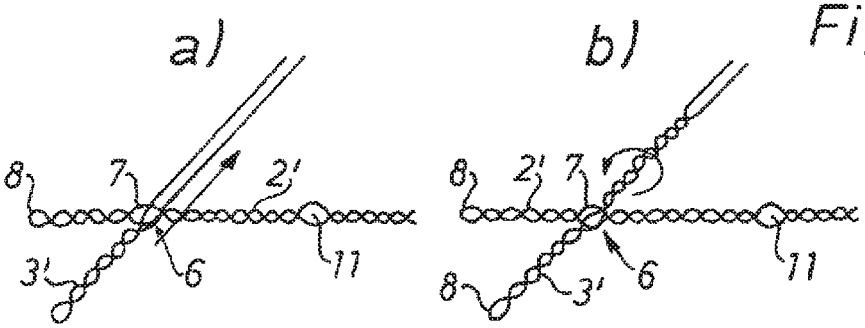
Figure 7:
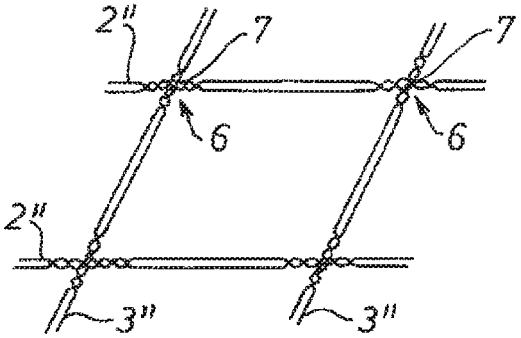
Figure 8:
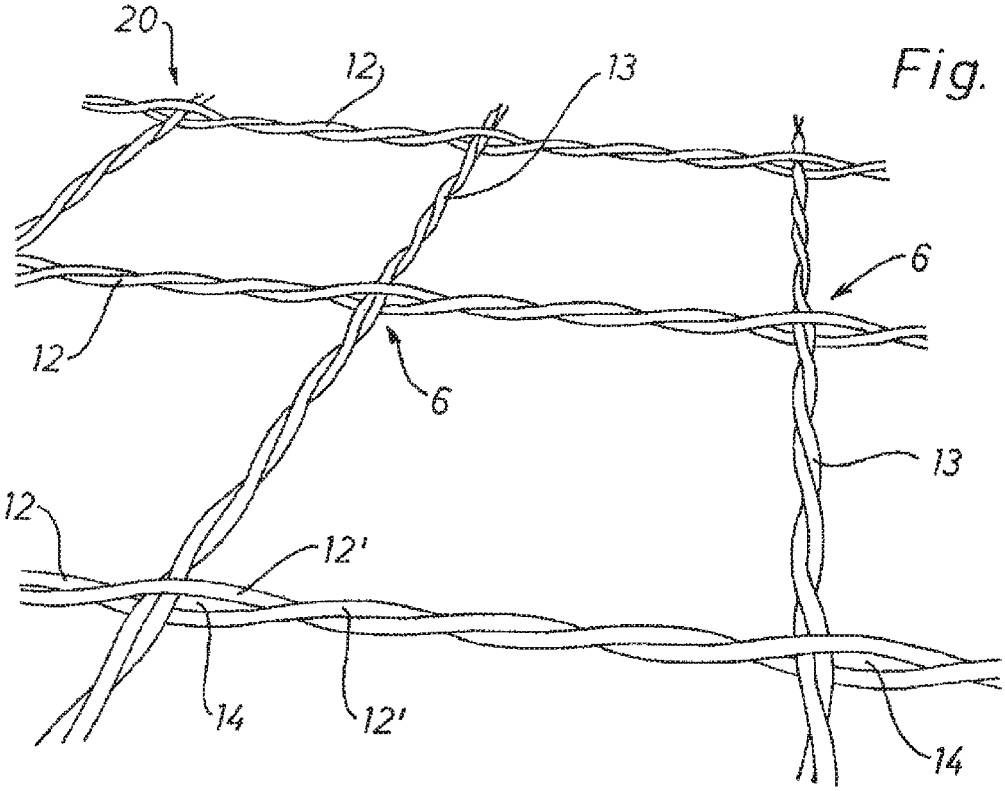
Figure 9:
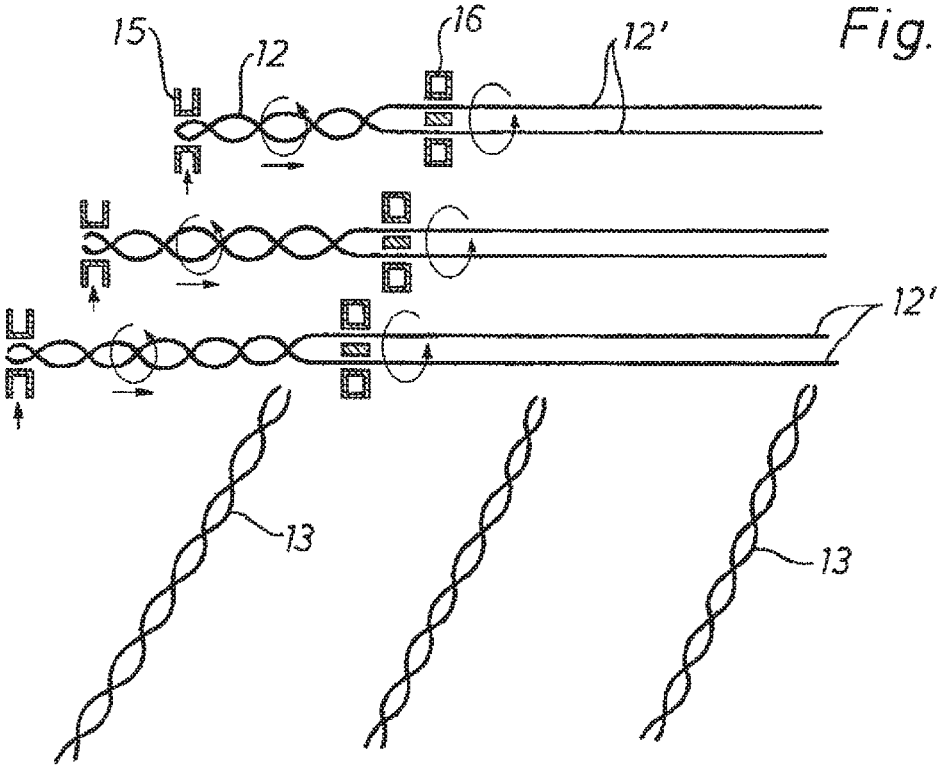
Figure 10:
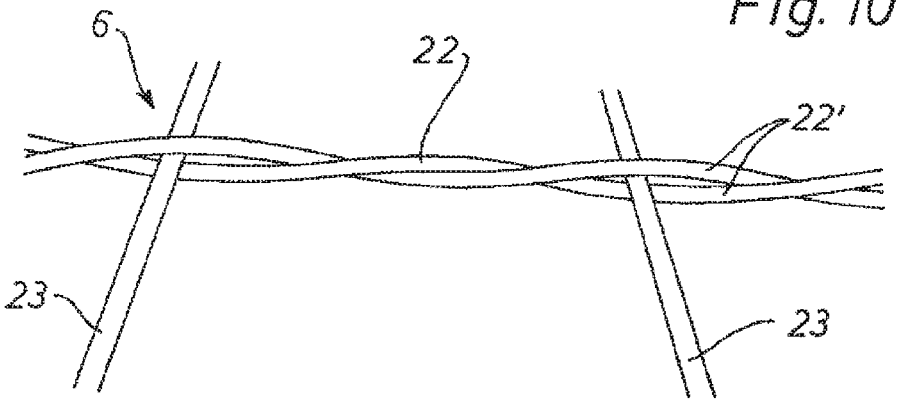
Figure 11:
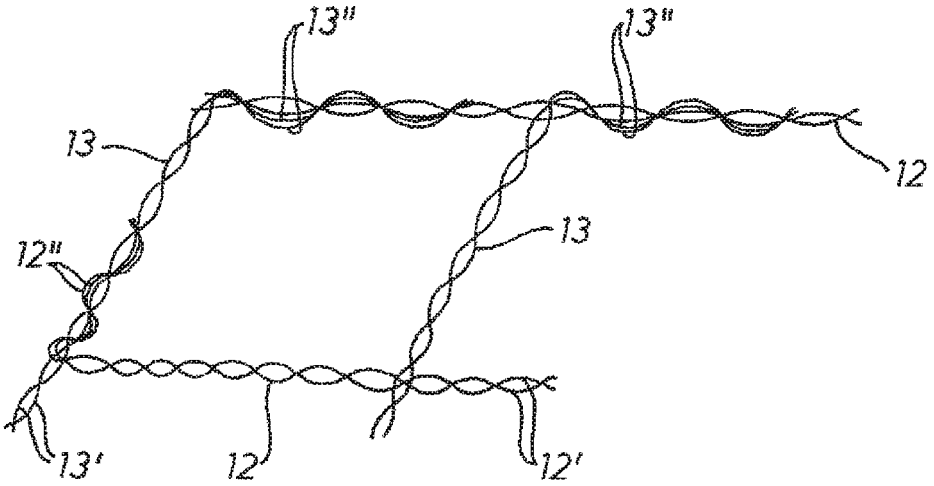

In the following, exemplary embodiments of the invention will be explained in detail by the drawings. It is shown in:

FIG. 1 a schematic perspective presentation of a lattice structure according to the invention;

FIGS. 2 *a, b* the longitudinal elements and transverse elements of the lattice of FIG. 1 prior to the twisting of the wire loops, depicted in a side view, respectively in a perspective view;

FIGS. 3 *a, b* two schematically depicted phases of the manufacturing process of the lattice structure of FIG. 1, respectively FIG. 2;

FIG. 4 a second embodiment of the lattice structure according to the invention, in a perspective presentation;

FIGS. 5 *a, b* a side view of a respective longitudinal, respectively transverse wire of the lattice structure of FIG. 4;

FIGS. 6 *a, b* a knot point of a lattice structure of FIG. 4, shown in two phases of the manufacturing process;

FIG. 7 a further embodiment of a lattice structure according to the invention, in a perspective view;

FIG. 8 a perspective view of a version of a lattice structure according to the invention;

FIG. 9 a perspective view of the lattice structure of FIG. 8 during manufacturing;

FIG. 10 a perspective view of a further version of a lattice structure according to the invention; and FIG. 11 a perspective view of a version of a lattice structure according to the invention.

The lattice structure 1 according to FIG. 1 to FIG. 3 is composed of longitudinal elements 2 and transverse elements 3, preferably made of steel, which are provided with perpendicularly standing loops 4 respectively 5. These longitudinal elements and transverse elements are in particular wires, strands, ropes, rods or profiles. They may however also be composite products containing steel and synthetics and/or synthetic products and may also be sandwich elements thereof.

Furthermore, in comparison to the longitudinal elements, the transverse elements may be differently dimensioned, and may be composed of different materials and/or of different materials having different properties, e.g. strengths.

Such a lattice structure 1 is suitable for a variety of applications in the field of reinforcement, protection and/or securing. Lattice structures of this kind may, for example, be inlaid and/or usable in concrete or asphalt for reinforcement, in the field of mining or similar fields for armoring.

They may however also be applied for other purposes, e.g. slope protection, on terrestrial surfaces of any kind or in constructions for protection from avalanches, rock fall or other natural dangers.

Beyond this, such lattice structures may be used for interior and exterior applications in buildings, e.g. as a permanent or mobile protective or separating element which, in a high-strength implementation, moreover increases safety from vandalism.

These lattices are producible continuously or in panels, and may in some embodiments be rollable, resulting in augmented application possibilities and in particular allowing simplifications regarding transport and assembly.

According to the invention, the wires of said lattice structure 1 are fixedly twisted with one another in the intersection points 6 by loops 4, 5, thus implementing knot points 7, which are thrust-resistant also in case of a load and bear up in case of deformations to the lattice. This results in a kind of positive-fit in these knot points 7:

In said lattice structure 1 the longitudinal elements 2 and transverse elements 3 are embodied as wires and are arranged lying in a plane perpendicularly to one another, wherein the knot points 7 are spaced apart from one another at equal distances both in a longitudinal direction and in a transverse direction.

It is of course also possible to provide different distances for the two directions. In both cases a geometry of the lattice is comparable, for example, to a geometry of reinforcing steel meshes.

As a further version, the intersection points 7 may be embodied zigzag-shaped instead of approximately rectangular. However, in a practice context the rectangular arrangement is to be considered advantageous both in terms of production technology and regarding their mechanical characteristics.

For the purpose of fixating the lattice structure 1, for example, to a frame encompassing the lattice structure 1, closed anchoring loops 8 are provided on the ends of the longitudinal elements 2 and transverse elements 3, allowing a regular fixation all around the lattice without additional means.

FIGS. 2 *a*) and *b*) show a longitudinal wire 2 prepared with loops 4 as well as, for an assembly, a transverse wire that is also prepared for an assembly with loops 5 that are positioned transversely at 90°. Thus prior to the twisting the loops 4, 5 are located in parallel side by side in the intersection points 6, allowing the twisting to be carried out in a simple manner.

Of course the loops may also be pre-formed in a different shape than shown. To form a strand, at least one further wire may be wound about the respective wire with the transversely positioned loops, the further wire comprising or not comprising a loop.

FIG. 3 *a*) depicts an intersection point 6 prepared for twisting the loops 4 and 5, wherein, in the scope of the invention, the wires 2 and 3 are inserted in definitely spaced-apart grooves 9' of an assembly plate 9 or the like to allow a positioning and fixedly holding for the purpose of twisting said wires 2 and 3. The grooves 9' are herein arranged in the assembly plate 9 spaced apart from one another by such distances that they correspond to mesh sizes of the lattice structure 1.

FIG. 3 *b*) shows the point with loops 4 and 5 twisted with one another. They form in this point a non-displaceable thrust-resistant knot point 7.

The lattice structure 10 of FIG. 4 and FIGS. 5 *a*) and *b*) differs from the lattice of FIG. 1 mainly in that herein the longitudinal elements and transverse elements 2' respectively 3' extend in two-fold, wherein not the created loops but each of the longitudinal elements and transverse elements 2' respectively 3' is twisted in itself, wherein the longitudinal wires 2' comprise pass-through regions 11 which are arranged distributed in a longitudinal direction and which the transverse elements 3' are passed through.

FIG. 5 *a*) shows a longitudinal wire 2 prepared for assembly, with regularly distributed pass-through regions 11 for receiving the transverse elements.

FIG. 5 *b*) illustrates a transverse wire 3' also prepared for assembly, which is still only twisted up to the first intersection point 6 of the lattice structure 10.

FIGS. 6 *a*) and *b*) show, in an assembly of the lattice structure 10, the transverse wire 3' being put through the first pass-through region 11 of the longitudinal wire 2' and being then further twisted up to the following pass-through region, wherein it is also fixedly twisted with the longitudinal wire 2' in a region of the intersection point 6. This procedure is repeated until the transverse wire 3' has been passed through all pass-through regions 11 of the longitudinal wires 2' completely. Suitably sized dimensioning of the pass-through regions 11 will result in a structure that is interlaceable at a certain angle and is thus rollable.

The lattice structure of FIG. 7 differs from the one of FIG. 4 only in that the longitudinal elements and transverse elements 2" respectively 3" are twisted only in a region of the intersection points 6 of said longitudinal elements and transverse elements 2" respectively 3" being passed into one another. Outside these points they remain non-twisted, parallel extending two-fold or multifold wires which may also be furnished at their ends with closed anchoring loops 8 for fixating the lattice to a frame encompassing the lattice. Instead of non-twisted, the longitudinal elements and transverse elements could also be wound together with some windings to form strands between the intersection points 6, for achieving increased stability.

The exemplary embodiments of FIG. 1, FIG. 4 and FIG. 7 could of course also be implemented vice versa to the arrangement described. In the embodiment according to FIG. 1 the longitudinal wires 2 comprise in such a case loops arranged transversely to a longitudinal direction while the transverse elements 3 are furnished with loops arranged in the longitudinal direction.

In the exemplary embodiments of FIG. 4 and FIG. 7 the pass-through regions 11 are arranged in the transverse elements 3' respectively 3", and the longitudinal wires 2' respectively 2" are passed through the transverse elements 3' respectively 3".

FIG. 8 shows a section of a lattice structure 20 with longitudinal elements and transverse elements 12, 13, which are configured as strands and are each implemented of two wound wires 12'. There could however also be more than two wires.

According to the invention, the transverse elements 13 are passed through pass-through regions 14 of the longitudinal elements 12 in the intersection points 6, the transverse elements 13 and the longitudinal elements 12 being thus in this way connected to one another via being passed into one another. Said pass-through regions 14 are herein implemented by openings in the wound wires 12' corresponding to mesh lengths.

FIG. 9 shows a particularly advantageous manufacturing of the lattice structure 20 of FIG. 8, in which a plurality of wires 12', which are arranged side by side in pairs, are simultaneously wound by a device, at a distance of mesh lengths, for the purpose of forming longitudinal elements 12. After generating a number of windings, each already wound transverse element 13 is passed through between respectively two wires 12' of the longitudinal elements 12 which have not yet been wound. Then the winding process of the longitudinal elements 12 is continued, the subsequent transverse element 13 being slid through the wires 12' in the same way, following a certain number of windings. Transverse elements could be arranged instead of longitudinal elements and vice versa.

Preferably, following the sliding-in and the further winding process of the longitudinal elements 12, said transverse elements 13 are connected to the latter in such a way that they are clamped between the wires 12,' the intersection points 6 being implemented knot-like at said wires 12'. This results in a force-fit connection in said intersection points.

Of this device for the winding of the wires 12' and the passing through of the transverse elements 13 only straight holders 15 at the beginning of the longitudinal elements 12 and rotating means 16 are shown schematically.

The lattice structure 20 could of course be also manufactured differently from the way explained above. For example, the completed strands could be arranged, with the corresponding mesh lengths, both at the longitudinal elements and the transverse elements 12, 13, and the longitudinal elements could herein be slid through wires of the wound transverse elements, which have been opened with respect to one another machine-wise in the elastic region, or vice versa, and then these opened wires could be released again, thus effecting a clamping of the passed-through transverse elements.

In FIG. 10 a section of a lattice structure is illustrated that is similar to the one of FIG. 9. Instead of strands single wires are used as transverse elements 23, which are passed through the wires 22', thus—also advantageously—generating the connection according to the invention in the intersection points 6 via a clamping of these transverse elements 23 by the wires 22'.

FIG. 11 schematically shows a section of a lattice structure like the ones depicted, for example, in FIG. 4 or FIG. 8, in which the wires 12' of the longitudinal elements respectively transverse elements 12, 13 are twisted or are twisted to form strands.

In the scope of the invention, said longitudinal elements respectively transverse elements 12, 13 are connected at their ends to neighboring transverse elements respectively longitudinal elements 13, 12. In the present exemplary embodiment the wires 12", 13" are angled at ends of the longitudinal elements respectively transverse elements 12, 13 and are held by wrapping around or winding with one another in case of the outermost transverse elements respectively longitudinal elements 13, 12, which are arranged at right angles thereto.

The longitudinal elements and/or transverse elements are advantageously made of high-tensile steel, preferably with a strength of 700 N $mm^{-2}$ to 2800 N $mm^{-2}$. Following the twisting, said knot points are thus held together with an even higher rigidity. It is also possible to provide longitudinal elements or transverse elements with a lower strength.

The lattice structure according to the invention permits generating any desired shapes and/or sizes of meshes. Principally said longitudinal elements and transverse elements may be arranged, with respect to one another, not at right angles as shown but also like, for example, in wire nettings, in which rhomboid-shaped meshes are implemented.

The longitudinal elements and/or transverse elements could also comprise loops bent by approximately 360°, which the transverse elements or longitudinal elements are passed through with or without twisting, as may be seen in the remaining figures. The knots are advantageously implemented of at least one winding of circle-shaped 360° loops, which are pre-formed in the provided intersection points and are in assembly formed at the transverse wires by passing through, guiding backwards and re-passing through the loops of the longitudinal wires. Herein the loops are threaded-in in such a way that they are positioned, with respect to the lattice plane, mirror-symmetrically to the loops of the longitudinal wires.

It is also possible that not all of the intersection points are implemented with a connection or twisting. For example, only every second intersection point or intersection points following a number of elements may be provided featuring connections, while the others are arranged adjacently to one another.

The invention claimed is:

1. A method for manufacturing a lattice structure, the lattice structure comprising:

intersecting longitudinal elements and transverse elements, intersection points being allocated to the longitudinal elements and transverse elements, the longitudinal elements extending in unifold fashion and the transverse elements extending in multifold fashion, wherein the transverse elements are embodied as wire strands, wherein the transverse elements comprise consistent winding directions, in particular before and after at least one of the intersection points and/or between at least two subsequent intersection points, wherein the longitudinal elements and transverse elements are made at least partly of high-tensile steel, and wherein the longitudinal elements are clamped between the high-tensile steel wire strands of the transverse elements by elastic clamping forces of the transverse elements, the method comprising:

machine-wise opening the wire strands of the transverse elements with respect to one another in an elastic region of the high-tensile steel material of the wire strands;

passing the longitudinal elements through the opened wire strands of the transverse elements, and releasing the opened wire strands of the transverse elements in order to effect the elastic clamping forces of the transverse elements on the passed-through longitudinal elements.

* * * * *